United States Patent [19]

Clement et al.

[11] Patent Number: 4,671,244

[45] Date of Patent: Jun. 9, 1987

[54] LAMBDA-CONTROLLED MIXTURE METERING ARRANGEMENT FOR AN INTERNAL COMBUSTION ENGINE

[75] Inventors: Albrecht Clement, Kornwestheim; Dieter Mayer, Wangen/Allgäu; Ernst Wild, Weissach-Flacht, all of Fed. Rep. of Germany

[73] Assignee: Robert Bosch GmbH, Stuttgart, Fed. Rep. of Germany

[21] Appl. No.: 708,269

[22] Filed: Mar. 5, 1985

[30] Foreign Application Priority Data

Mar. 9, 1984 [DE] Fed. Rep. of Germany ..... 3408635

[51] Int. Cl.[4] ..... F02D 41/14

[52] U.S. Cl. ..... 123/489; 123/440

[58] Field of Search ..... 123/440, 489

[56] References Cited

U.S. PATENT DOCUMENTS

| | | | |
|---|---|---|---|
| 4,029,061 | 6/1977 | Asano | 123/440 |
| 4,116,170 | 9/1978 | Anzai | 123/440 |
| 4,153,022 | 5/1979 | Asano et al. | 123/440 |
| 4,163,433 | 8/1979 | Fujishiro | 123/440 |
| 4,214,558 | 7/1980 | Nishioka et al. | 123/440 |
| 4,320,730 | 3/1982 | Takada et al. | 123/440 |
| 4,442,817 | 4/1984 | Auth et al. | 123/489 |
| 4,462,373 | 7/1984 | Kanno | 123/440 X |
| 4,528,962 | 7/1985 | Auth | 123/489 |

*Primary Examiner*—Tony M. Argenbright
*Attorney, Agent, or Firm*—Walter Ottesen

[57] ABSTRACT

The invention is directed to a mixture metering arrangement for an internal combustion engine and includes an exhaust-gas sensor which is exposed to the exhaust gas of the internal combustion engine. The exhaust-gas sensor indicates the air ratio lambda and preferably has a two-level characteristic. The sensor output signals are acted upon by a follow-on controller which is preferably a PI-controller. The controller output quantity acts upon the mixture composition in a corrective fashion. In this arrangement, the control oscillation of the controller output quantity is adjusted to a predetermined amplitude by means of a superposed control. In particular, the integral component of the control oscillation is influenced in a manner causing it to have the same amplitude as the proportional component while in the steady operating condition. Thus, it is possible to maintain the maximum control frequency in any operating range of the internal combustion engine so that the controller always operates at its optimum. In addition, the effects of deviations occurring from one engine to another or from one exhaust-gas sensor to another as well as of long-term variations are suppressed.

10 Claims, 7 Drawing Figures

LAMBDA-CONTROLLED MIXTURE METERING ARRANGEMENT FOR AN INTERNAL COMBUSTION ENGINE

FIELD OF THE INVENTION

The invention relates to a mixture metering arrangement for an internal combustion engine. The arrangement includes an exhaust gas sensor subjected to the exhaust gas of the engine. The exhaust gas sensor indicates the air ratio lambda and preferably has a two-level characteristic. The signals of the sensor are supplied and subjected to the action of a control function means which is preferably a PI-controller. The output quantity of the control function means acts in a corrective manner on the composition of the mixture.

BACKGROUND OF THE INVENTION

A mixture metering arrangement of this type is known, for example, from U.S. Pat. No. 4,442,817. In this patent, an arrangement is disclosed wherein the mixture composition is anticipatorily controlled in dependence on various operating parameters of the internal combustion engine and a superposed lambda control acts on these anticipatory control values in a corrective fashion. Because the internal combustion engine, as a controlled system, has a dead time which is primarily attributable to the time required for the gas to pass through the engine and to the response time of the lambda sensor, and because the lambda sensor output signal is nearly binary, a continuous oscillation occurs in the lambda control having a frequency which is determined by the dead time and an amplitude which is determined by the control parameters. The general rule here is that the higher the value of the control amplitude becomes, the faster disturbances are levelled.

On the other hand, with the control amplitude increasing, a rough operation of the internal combustion engine develops because of a torque change caused by the control. Further, particularly in situations of dynamic transition occurring during the operation of the internal combustion engine, undesirable exhaust peaks may occur as a result of excessive control oscillations. The reason for this is that in such an event the lambda control may temporarily run up against its limit. In the above-identified patent, it is suggested that the slope of the integral component of the control oscillation of the PI-controller be reduced to a minimum in successive correction cycles during steady or quasi-steady operational conditions of the internal combustion engine. If the internal combustion engine enters a steady operating condition, the slope of the integral component will be reduced to a predetermined maximum value. The process involved here is a pure control of the integrator slope which does not permit the compensation of long-term or short-term drifts occurring during the life of the internal combustion engine. In addition, this controlled adaptation of the integrator slope only takes effect during steady operating conditions.

SUMMARY OF THE INVENTION

By contrast, the mixture metering arrangement according to the invention is considerably less complicated to apply because the arrangement adapts itself automatically to deviations occurring from one engine to another and from one lambda sensor to another and to long-term changes of engine and sensor. Further, the mixture metering arrangement of the invention affords an optimum compromise between the operating performance of the internal combustion engine and exhaust emissions.

Moreover, it is advantageous that the amplitude values of the proportional component and integral component of the control oscillation are of equal magnitude in the steady operating condition. This ensures that the control frequency of the lambda control assumes an optimal value.

Another advantage results if the mean value of the control oscillation is to be intentionally shifted by asymmetric proportional or integral components. Such an asymmetric control oscillation for the generation of a lambda shift is necessary because, on account of the nearly binary signal of the lambda sensor, the shift cannot be set by means of other desired lambda values. However, the magnitude of the lambda shift is dependent on the amplitude of the control oscillation so that this unwanted dependence is of no consequence for an oscillation amplitude regulated to constant values.

Further advantages of the invention will become apparent from the subsequent description of embodiments taken in conjunction with the drawing and the appended claims.

BRIEF DESCRIPTION OF THE DRAWING

The invention will now be described in more detail in the following with reference to the drawing wherein.

DESCRIPTION OF THE PREFERRED EMBODIMENTS OF THE INVENTION

The following embodiments will be described with reference to a fuel injection system. It is to be understood, however, that the lambda control per se is independent of the type of mixture metering, so that the invention may also be used in combination with carburetor systems, for example.

Figure 1:
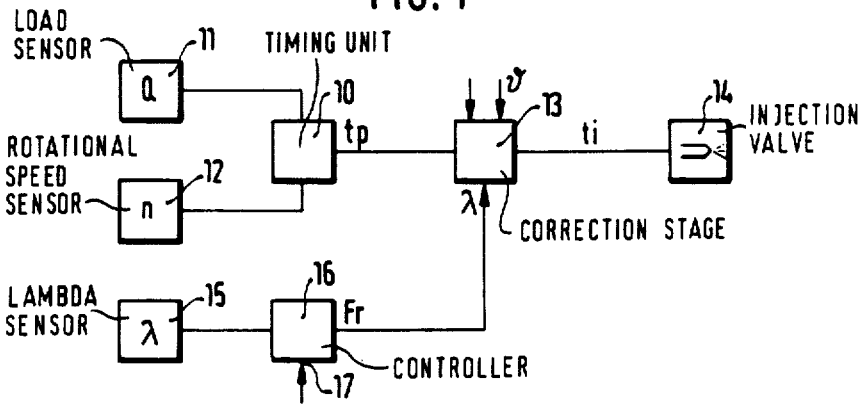
FIG. 1 is a block diagram illustrating the basic components of an electronically controlled mixture metering arrangement for an internal combustion engine.

Referring now to FIG. 1, reference numeral 10 identifies a timing unit which receives input signals for a load sensor 11 and from a rotational speed sensor 12 and issues at its output anticipatory control values of a duration $t_p$ for the injection pulses. The anticipatory control values are corrected in a follow-on correction stage 13 in dependence on, for example, the temperature of the internal combustion engine or acceleration processes, and particularly in dependence on a lambda control. The corrected pulses $t_i$ are finally applied to at least one injection valve 14 located in the area of the intake pipe (not shown) of the internal combustion engine.

An exhaust gas sensor 15 delivers its output signal to a controller 16 which is preferably a PI-controller. In dependence on this signal and on further characteristic quantities of the internal combustion engine which are applied to a control input 17, controller 16 generates a lambda correction signal $F_r$ which is supplied to the input of correction stage 13. The arrangement of FIG. 1 is known per se and will provide background to the explanation of the arrangement of the invention.

Figure 2:
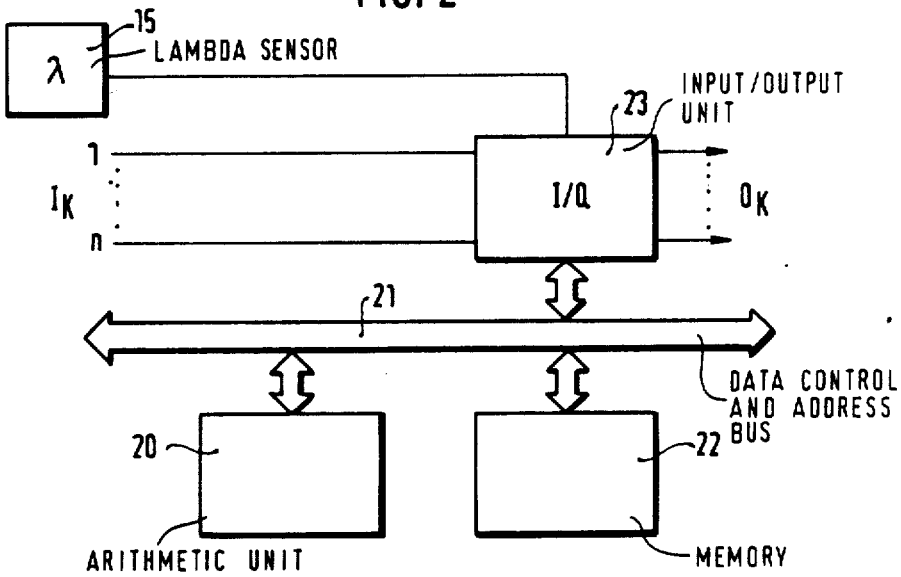
FIG. 2 is a simplified schematic of a lambda control incorporating a microcomputer.

In view of the increasing demands on mixture metering arrangements for internal combustion engines, computer-controlled solutions are being predominantly adopted nowadays. Therefore, the purpose of FIG. 2 is to provide a schematic outline of such embodiments together with their major components. Reference numeral 20 identifies an arithmetic unit coupled to a memory 22 and an input/output unit 23 via a data, control and address bus 21. In addition to receiving a signal from exhaust gas sensor 15, input/output unit 23 receives several input quantities $I_k$ and issues several output quantities $O_k$, for example, a signal indicative of the duration of fuel injection. The mode of operation of the arrangement of FIG. 2 is governed by the programming of the computer. Programming per se presents no problem to those skilled in the art of electronic control systems for internal combustion engines, so that in the further description of the invention reference will be made to conventional block diagrams rather than a program.

Figure 3A:
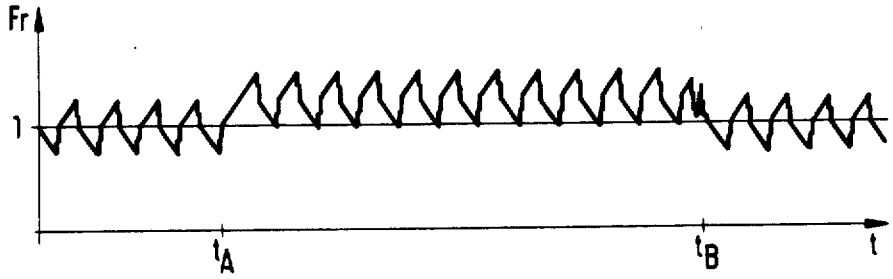
FIGS. 3*a* to 3*c* are diagrams illustrating the output signals of a state-of-the-art lambda controller.
Figure 3B:
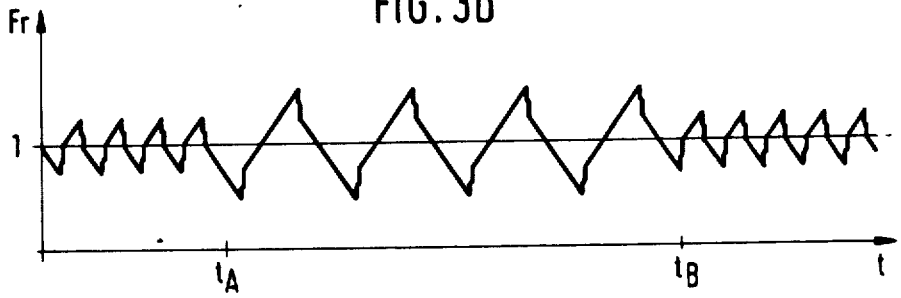
Figure 3C:
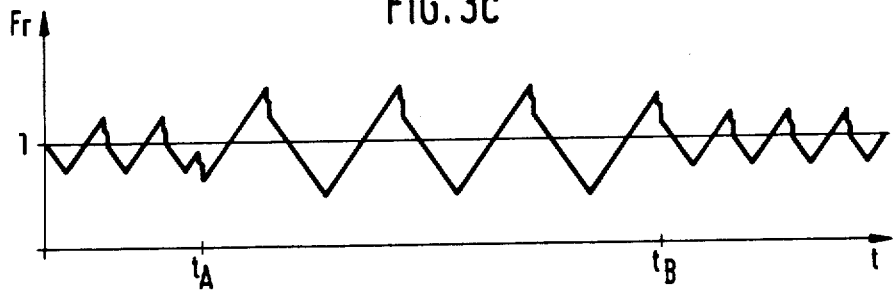

The diagrams of FIG. 3 assist in explaining the mode of operation of state-of-the-art mixture metering arrangements. The diagrams show the lambda correction signal $F_r$ which influences the anticipatory control values for the fuel quantity to be injected and is plotted against time t. The units are arbitrarily chosen. In the special situation shown, the signal shape is made up of an integral component and a proportional component. Since the exhaust gas sensor utilized in the present embodiment, which can be configured as an oxygen sensor, issues an output quantity which essentially assumes only two values, that is, a high output level indicating a rich air-fuel mixture and a low output level indicating a lean air-fuel mixture, the signal shape of correction factor $F_r$ will result as will now be explained. When the output quantity of the oxygen sensor switches from rich to lean or from lean to rich, a proportional component will be effective at the output of controller 16. During the period of time the sensor signal dwells in either one of the two output states, the integral component of the controller will be effective. The duration of time in which the controller acts as an integral controller depends on the dead time behavior of the controlled system which is essentially attributable to the time the gas requires for passage through the internal combustion engine. Accordingly, the continuous oscillations shown in FIGS. 3*a* to 3*c* result.

From FIG. 3*a* it will be seen that the mean value of the control oscillation is at $F_r=1$ for times $t<t_A$. This means that the anticipatory control value for the fuel quantity to be injected is properly chosen for the instantaneous operating conditions which are just now present so that the lambda control need not intervene in a corrective fashion. With the operating conditions changed, the anticipatory control value for fuel metering is incorrect between times $t_A$ and $t_B$ so that corrective action by the lambda control is required. Because the sensor output signal dwells on one of the two possible levels, the integral action of the controller will continue to change the controller output quantity $F_r$ until correction stage 13 has corrected the quantity of fuel injected to the desired value.

In the embodiment shown, the mean value of correction factor $F_r$ oscillates about $F_r>1$, permitting the conclusion that the anticipatory control value corresponds to an insufficient quantity of fuel. From this embodiment it will also be seen that an adjustment of the anticipatory control values which is not entirely correct does not necessarily increase the controller oscillation in the steady state operation. When appropriately chosen and with the dead time constant, the amplitude components of the control oscillation of correction factor $F_r$ which are attributable to the proportional component or integral component constantly assume values of like magnitude in the steady state operation, whereby an optimum control frequency is achieved.

The situation will change completely if, as shown in FIG. $3_b$, the dead time of the controlled arrangement is altered. The dead time of the controlled arrangement is highly dependent on rotational speed and load so that it is subject to very frequent changes. An increase in the dead time between times $t_A$ and $t_B$ causes an overshoot of the control oscillation which results solely from the integral action of controller 16. In the extreme case of very high amplitudes, this can become noticeable from torque changes of the internal combustion engine and a consequential uneven running condition accompanied by higher exhaust emission values. Further, it is then no longer possible to maintain the optimum relationship between the control oscillation amplitudes attributable to the proportional component and integral component. From this results a reduced frequency of the control oscillation which leads to a still more sluggish performance of the entire arrangement.

Another disadvantage of known arrangements is illustrated in the diagram of FIG. $3_c$. Because in this embodiment the proportional component is set at zero value when the oxygen sensor output signal jumps from rich to lean, a lambda shift results which in some cases is desirable and intentionally caused. Generally, the lambda shift is accomplished by differing proportional components between the rich-lean jump and the lean-rich jump. In this arrangement, it is not necessary for the one proportional component to be equal to zero. The amount of this shift results from the difference between the portions of area above and below the line at $F_r=1$. In this embodiment, too, an increase in the dead time of the controlled arrangement is assumed during the period between $t_A$ and $t_B$. By increasing the amplitude of the control oscillation, a changed shift of control factor $F_r$ will also occur so that this intentionally caused lambda shift becomes dependent on the amplitude of the control oscillation.

From all these disadvantages of the state of the art, there results the requirement for an adaptation of the slope of the integral component of controller 16, such that the slope continues to be corrected in dependence on the preceding control amplitude until the predetermined desired amplitude of the control oscillation is attained. The exact value of the amplitude of the control oscillation is to be determined on a case-by-case basis. While the disturbance of the instant is eliminated very rapidly for high control amplitudes, smooth running of the internal combustion engine will also ensue as the control amplitude increases. Accordingly, the amplitudes of the control oscillation are to be set at values which lie slightly below the limit which impairs the driving comfort of a motor vehicle equipped with such an internal combustion engine. Next, the exhaust gas variations occurring in connection therewith are to be noted; however, the major part of these variations will be averaged out by the buffer action of a follow-on catalyzer. Thus, the upper limit for the amplitude of the control oscillation is determined by either the driving performance or an upper threshold value for the exhaust emission. For those skilled in the art, the determination of the amplitude of the control oscillation is a routine matter.

Figure 4:
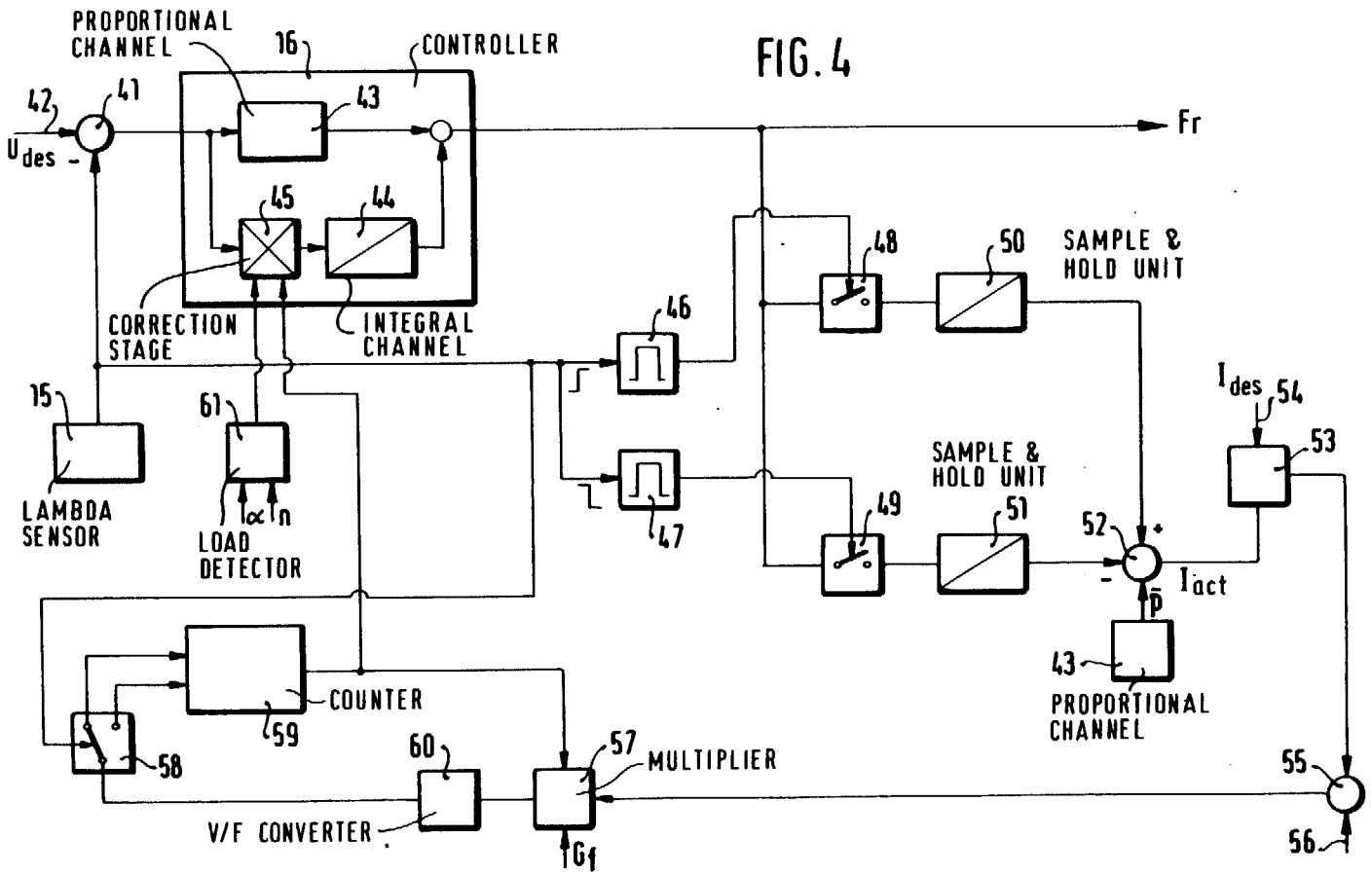
FIG. 4 is a block diagram of a controller for the mixture metering system of the invention; and, FIG. 5 is a diagram illustrating the output signals of the controller of FIG. 4.

FIG. 4 illustrates an embodiment of the controller for the mixture metering arrangement of the invention. The output signals of exhaust-gas sensor 15 are passed to a comparator 41 wherein they are compared with a predetermined desired value 42. The result of this comparison is an input to controller 16 the output signals $F_r$ of which correct, for example, the duration of injection. Controller 16 includes a proportional channel 43 and a parallel integral channel 44 which is preceded by a correction stage 45.

The output signals of exhaust gas sensor 15 are also fed to two monoflop stages 46 and 47 which actuate at their outputs switches 48 and 49, respectively. In this arrangement, monoflop stage 46 responds to the positive edge, and monoflop stage 47 to the negative edge of the output signal of exhaust-gas sensor 15. Via switches 48 and 49, the output signal $F_r$ of controller 16 is applied to the respective inputs of two sample-and-hold units 50 and 51. The output signals of sample-and-hold units 50 and 51 are passed to a comparator 52 together with the signals of proportional channel 43 of controller 16. A follow-on divider 53 forms the quotient of the output signal of comparator 52 and a predetermined desired value 54. Comparator 55 compares this quotient with a desired value 56 and the result is fed to a multiplier 57 together with other quantities.

The output quantity of multiplier 57 goes via a voltage/frequency converter 60 and a switch 58 to a counter 59. The counting direction of counter 59 depends on the position of switch 58. Switch 58 is actuated on every edge change of the output quantity of exhaust gas sensor 15. The reading of counter 59 acts upon correction stage 45 and multiplier 57. Further, multiplier 57 can be supplied with another input quantity $G_f$. In many applications, it is useful to apply the signals of a load detector 61 to correction stage 45, the load detector 61 receiving suitable engine characteristic quantities such as $Q_L$, $\alpha$, n or p.

The operation of the arrangement of the invention will now be described.

Sample-and-hold amplifiers 50, 51 store the amplitudes of the control oscillation at the switch-over points of the output quantity of exhaust-gas sensor 15. Comparator 52 forms the difference between these values, so that the amplitude of the control oscillation is available at its output. In order to determine solely the amplitude of the integral component, comparator 52 additionally subtracts the proportional component of the control oscillation. In various cases it is advantageous to set the proportional component to be subtracted at zero because this can reduce the complexity of the computation. After a division of the output quantity of comparator 52 by a predetermined desired quantity 54 and a comparison of this quotient in comparator 55 with a desired value 56, which particularly assumes the value of unity (1), multiplier 57 will multiply the result by the output quantity of counter 59. Multiplier 57 influences the counting speed of counter 59 via voltage/frequency converter 60. Correction stage 45 influences the slope of the integral component of the control oscillation in dependence on the reading of counter 59.

Via a load detector 61 receiving engine characteristic quantities such as rotational speed n, throttle position $\alpha$ or rate of air flow Q, it is possible to perform an anticipatory control of the integral component of the control oscillation in dependence on the load of the internal combustion engine. Such an arrangement is disclosed, for example, in U.S. Pat. No. 3,831,564.

The arrangement described essentially has to fulfill three functions, that is, to measure the integrator slope, to compare the latter with the desired slope, and to correct the actual integrator slope. Because the amplitude of the control oscillation attains its maximum value $A_o$ within a cycle at a point in time when the output quantity of the exhaust gas sensor switches from lean to rich and attains its minimum $A_u$ on a switch from rich to lean, it is possible to form the actual amplitude $A_i = A_o - A_u$ by storing these extreme values, followed by subtraction. If, in addition, the proportional component P is subtracted, that amplitude portion of the control oscillation is obtained that is solely attributable to the integral component $I_i = A_i - P$. The proportional component here may assume asymmetrical values, that is, on a switch of the exhaust gas sensor output signal from lean to rich, the proportional value may differ from the value occurring on a rich-to-lean switch.

The slope of the integral component for a new cycle may be computed from the slope of the integral component of a preceding cycle applying the following equation:

$$S_{new} = \frac{I_{so}}{I_i} \cdot S_{old}$$

The equation $$S_{new} = S_{old} + \Delta S = \frac{I_{so}}{I_i} \cdot S_{old}$$

results in the following relationship for the change of the integrator slope $\Delta S$:

$$S = S_{old} \cdot \left( \frac{I_{so}}{I_i} - 1 \right)$$

Because in the event of changes in the anticipatory control values or sudden disturbances, the mean value of the oscillation shifts and, therefore, the deviation from the old mean value has to be compensated for over an additionally extended integrator time; the increase in amplitude can cause inaccuracies in the computation of the new integrator slope. In order to suppress this effect for the most part, a weighting factor $G_f$ is introduced which essentially assumes values of $G_f < 1$. This reduces the maximum possible rate of change with respect to the integrator slope, so that this slope does not assume the desired value until after several oscillations. The influence of an individual slope increased by a mean value shift of the oscillation is thereby suppressed considerably.

Instead of comparing the amplitudes I caused solely by the integral component of the control oscillation, the mean value shift may also be suppressed by comparing the total amplitudes $A = I + P$, for which purpose the proportional component to be subtracted in comparator 52 is set at zero value. This would likewise result in a reduction of the rate of change of the integrator slope. Moreover, such an embodiment would also reduce the complexity of the computation. It is to be emphasized that those skilled in the art and having knowledge of the described relationships are in a position to implement both an analog and a digital microcomputer-controlled embodiment of the invention.

In the following, a flowchart for a computer-controlled embodiment of the invention is disclosed. The flowchart is self-explanatory.

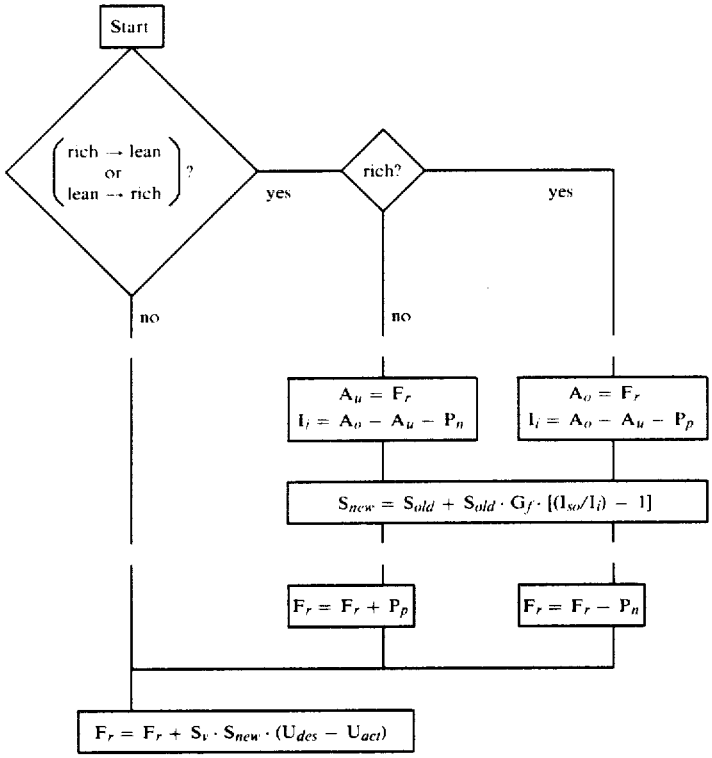

Figure 5:
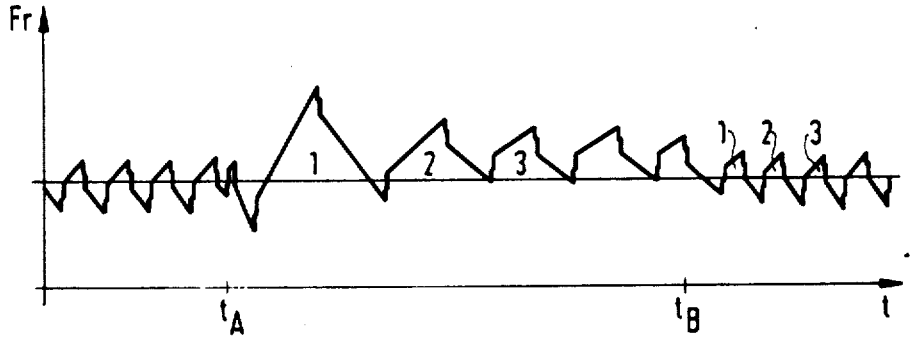

Abbreviations:

$A_u$—lower amplitude value
$A_o$—upper amplitude value
$F_r$—outer of lambda controller
$P_n$—negative proportional component
$P_p$—positive proportional component
$I_i$—actual amplitude
$S_{new}$—new integrator slope correction value
$S_{old}$—old integrator slope correction value
$G_f$—weighting factor
$I_{des}$—desired amplitude
$S_v$—anticipatory control value of integrator slope
$U_{des}$—desired voltage of lambda sensor
$U_{act}$—actual voltage of lambda sensor In FIG. 5, the output signal $F_r$ of a controller in the mixture metering arrangement of the invention is plotted as a function of time. At time $t_A$, the anticipatory control value and the dead time of the control loop (combination of the effects of FIGS. $3_a$ and $3_b$) change abruptly and simultaneously. In spite of the simultaneous change of these two quantities, the arrangement of the invention has adapted the integrator slope already after about three oscillation cycles so that the amplitude of the control oscillation is at the desired value.

On the whole, the arrangement of the invention permits the maximum control frequency to be attained because the amplitudes of the proportional and integral components of the control oscillation are adjusted to values of equal magnitude by means of an adaptation of, in particular, the integrator slope. As a result, the controller always operates optimally. Also, deviations occurring from one engine to another or from one exhaust-gas sensor to another and long-term changes of engine and exhaust-gas sensor no longer have an adverse effect because of the adaptation of the integrator slope. While the embodiments of the invention have been described with reference to an injection system, it is irrelevant for the invention in what particular manner the preparation of the fuel mixture takes place.

It is understood that the foregoing description is that of the preferred embodiments of the invention and that various changes and modifications may be made thereto without departing from the spirit and scope of the invention as defined in the appended claims.

What is claimed is:

1. Mixture metering arrangement for an internal combustion engine comprising:

an exhaust-gas sensor for indicating the air-fuel ratio lambda and being subjected to the exhaust gas of the engine, said exhaust-gas sensor having a two-level characteristic;

a PI-controller for receiving the output signals of said exhaust-gas sensor and for providing an output signal including an integral component and a proportional component to act correctively on the composition of said mixture; and, superposed closed-loop control means for adjusting the control oscillation of said output signal to a predetermined amplitude via the integral component.

2. Mixture metering arrangement of claim 1, said integral component having the same amplitude as said proportional component in the steady operating condition of the engine.

3. Mixture metering arrangement of claim 1, comprising means for anticipatorily controlling the actual value of the slope of said integral component in dependence upon operational characteristic quantities of the engine which are dependent upon at least the load condition of the latter.

4. Mixture metering arrangement of claim 1, the influence of said superposed control means on said integral component being influenceable by a weighting factor ($G_f$).

5. Mixture metering arrangement of claim 4, said weighting factor ($G_f$) being adjusted to values of $G_f < 1$.

6. Mixture metering arrangement of claim 1, wherein the mixture composition has anticipatory control values associated therewith, and wherein operating characteristic quantities of the engine independently influence the integration rate of said PI-controller with said closed-loop control means maintaining the amplitude of said output signal, said output signal of said PI-controller acting correctively upon said anticipatory control values for said mixture composition.

7. Mixture metering arrangement of claim 6 said operating characteristic quantities being selected from the group consisting of engine rotational speed, air flow rate or load.

8. Mixture metering arrangement for an internal combustion engine comprising:

an exhaust-gas sensor for indicating the air ratio lambda and being subjected to the exhaust gas of the engine, said exhaust-gas sensor having a two-level characteristic;

control function means for receiving the output signals of said exhaust-gas sensor and for providing an output quantity to act correctively on the composition of said mixture;

superposed control means for adjusting the control oscillation of said output quantity to a predetermined amplitude;

said control function means being a PI-controller and said control oscillation of said output quantity including an integral component and a proportional component; and, said superposed control means including means for setting said proportional component of said control oscillation in relationship to the measured amplitude of the latter.

9. Mixture metering arrangement for an internal combustion engine comprising:

an exhaust-gas sensor for indicating the air ratio lambda and being subjected to the exhaust gas of the engine, said exhaust-gas sensor having a two-level characteristic;

control function means for receiving the output signals of said exhaust-gas sensor and for providing an output quantity to act correctively on the composition of said mixture;

superposed control means for adjusting the control oscillation of said output quantity to a predetermined amplitude;

said control function means being a PI-controller and said control oscillation of said output quantity including an integral component and a proportional component;

said superposed control means including means for influencing said integral component of said control oscillation;

means for determining the actual value of the slope of said integral component in time sequence;

comparator means for comparing said actual value with a desired value; and, means for correcting said slope utilizing the comparison of said last-mentioned values.

10. Mixture metering arrangement for an internal combustion engine comprising:

an exhaust-gas sensor for indicating the air ratio lambda and being subjected to the exhaust gas of the engine, said exhaust-gas sensor having a two-level characteristic;

control function means for receiving the outout signals of said exhaust-gas sensor and for providing an output quantity to act correctively on the composition of said mixture;

superposed control means for adjusting the control oscillation of said output quantity to a predetermined amplitude;

said control function means being a PI-controller and said control oscillation of said output quantity including an integral component and a proportional component;

said superposed control means including means for influencing said integral component of said control oscillation;

means for determining the actual values of the amplitude of said control oscillation in time sequence;

comparator means for comparing said actual values with a desired value; and, means for correcting the slope of said integral component utilizing the comparison of said last-mentioned values.

* * * * *

UNITED STATES PATENT AND TRADEMARK OFFICE

CERTIFICATE OF CORRECTION

PATENT NO. : 4,671,244

DATED : June 9, 1987

INVENTOR(S) : A. Clement et al

It is certified that error appears in the above-identified patent and that said Letters Patent is hereby corrected as shown below:

In column 4, line 30: delete "FIG. $3_c$." and substitute -- FIG. 3c. -- therefor.

In column 7, line, 42: delete "outer" and substitute -- output -- therefor.

In column 10, line 29: delete "outout" and substitute -- output -- therefor.

Signed and Sealed this

Fourteenth Day of June, 1988

*Attest:*

*Attesting Officer*

DONALD J. QUIGG

*Commissioner of Patents and Trademarks*